United States Patent [19]

Haasl et al.

[11] 4,342,634

[45] Aug. 3, 1982

[54] CONTINUITY SPRING FOR A HYDRAULIC CYLINDER

[75] Inventors: William D. Haasl, Fond du Lac; Robert B. Weronke, Oshkosh, both of Wis.

[73] Assignee: Brunswick Corporation, Skokie, Ill.

[21] Appl. No.: 106,589

[22] Filed: Dec. 26, 1979

[51] Int. Cl.[3] ..... C23F 13/00

[52] U.S. Cl. ..... 204/197; 204/196; 91/422

[58] Field of Search ..... 91/170 R, 422; 204/147, 204/148, 196, 197

[56] References Cited

U.S. PATENT DOCUMENTS

| | | | |
|---|---|---|---|
| 1,608,709 | 11/1926 | Mills | 204/197 |
| 2,486,871 | 11/1949 | Osterheld | 204/197 |
| 2,805,988 | 9/1957 | Rader | 204/197 |
| 2,829,099 | 4/1958 | Marsh | 204/197 |
| 3,326,791 | 6/1967 | Heuze | 204/196 |
| 3,434,449 | 3/1969 | North | 91/170 R |
| 3,468,780 | 9/1969 | Fischer | 204/195 S |
| 3,711,394 | 1/1973 | Minushkin et al. | 204/195 S |
| 3,867,274 | 2/1975 | Herman | 204/197 |
| 4,050,359 | 9/1977 | Mayer | 91/422 |
| 4,093,529 | 6/1978 | Strobach | 204/197 |

OTHER PUBLICATIONS

MerCruiser Bulletin No. 77-11, Aug. 1, 1977.

*Primary Examiner*—R. L. Andrews
*Attorney, Agent, or Firm*—O. Thomas Sessions

[57] ABSTRACT

A continuity spring (27) is provided to make electrical contact between the cylinder (13) and piston rod (14) of a hydraulic piston-cylinder (10). The spring (27) is mounted in an annular groove (28) in the end cap (15) of the cylinder. A straight section (29) of the spring (27) contacts both the cylinder (13) and the piston rod (14) to establish electrical contact between the piston rod (14) and a cathodic protection system (25).

11 Claims, 3 Drawing Figures

FIG. 2
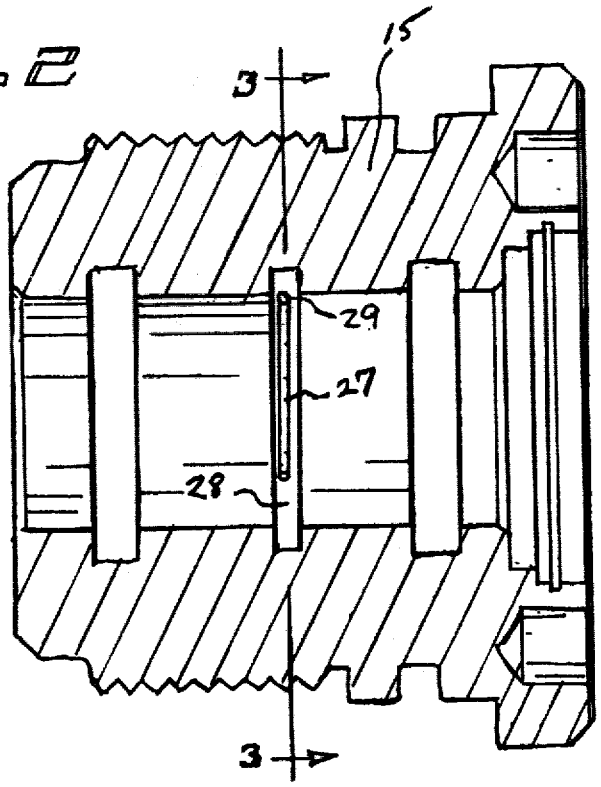
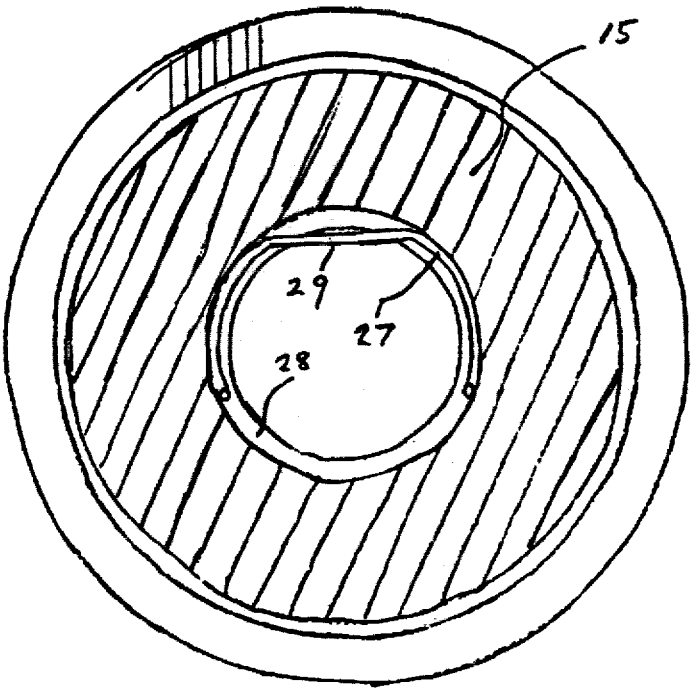
FIG. 3

CONTINUITY SPRING FOR A HYDRAULIC CYLINDER

DESCRIPTION

1. Technical Field

This invention relates to hydraulic cylinders, and particularly to those cylinders attached to devices having a cathodic corrosion protection system.

In the operation of hydraulic cylinders it is often difficult to provide electrical continuity between the piston rod and cylinder, particularly in environments where it is desirable to protect the rod and cylinder from corrosion with a cathodic protection system.

2. Background Art

It has been recognized in the art that hydraulic cylinders of the type using O-rings or other electrically insulating seals around the piston and piston rod must have both the piston rod and cylinder electrically connected to a cathodic protection system to receive the protection of that system. Various springs and wires have been used to provide electrical continuity between the relatively moving parts. The prior devices have all been relatively fragile devices external to the cylinder and thus subject to wear and rapid deterioration. Further, the prior devices are not an integral part of the cylinder and are easily omitted or removed.

DISCLOSURE OF INVENTION

The present invention is a sliding metal contact for establishing electrical contact between the piston rod and cylinder. It is useful in hydraulic piston-cylinders of the type having a metal cylinder and a metal piston rod extending out one end of the cylinder when electrical contact between the rod and cylinder is not otherwise assured.

BRIEF DESCRIPTION OF DRAWINGS

FIG. 2 is an enlarged sectional view of the cylinder end cap.

FIG. 3 is a sectional view taken on line 2—2 of FIG. 2.

BEST MODE FOR CARRYING OUT THE INVENTION

Figure 1:
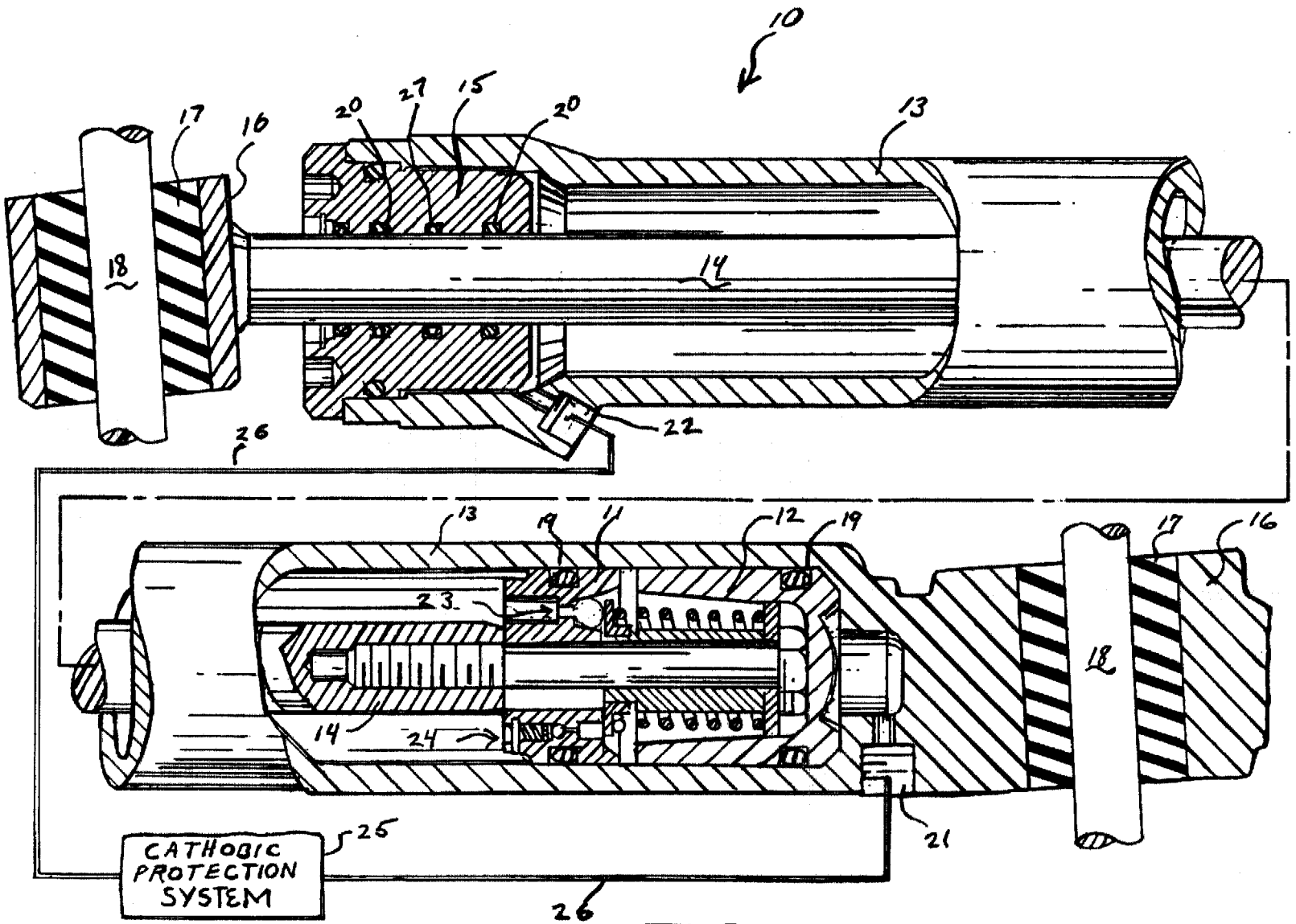
FIG. 1 is a sectional view of a hydraulic cylinder embodying the present invention.

Referring to the figures, FIG. 1 shows a hydraulic cylinder 10 according to the invention. The particular hydraulic cylinder illustrated is a trim cylinder for use with outboard propulsion units. The details and operation of such cylinders are disclosed in U.S. Pat. Nos. 3,434,449 to North and 4,050,359 to Mayer and serve both as a hydraulic ram and as a shock absorber.

The trim cylinder 10 has a shock piston 11 and trim piston 12 mounted for reciprocation in aluminum cylinder 13. The shock piston 11 is rigidly connected to a stainless steel piston rod 14 which extends through cylinder end cap 15. The base end of the cylinder 13 as well as the opposed end of piston rod 14 are provided with mounting eyes 16 and annular resilient mounting bushings 17. The piston rod 14 and cylinder 13 are attached by bolts 18 to the outboard propulsion unit and the transom bracket assembly (not illustrated). A sliding seal between the pistons 11 and 12 and cylinder 13 is provided by O-rings 19. A similar seal is provided between the end cap 15 and piston rod 14 by O-rings 20.

Extension of the piston rod 14 is achieved by applying hydraulic pressure to inlet 21 and the rod 14 may be retracted by applying hydraulic pressure to inlet 22. In the event of a shock load tending to extend rod 14, shock valve 23 in the shock piston 11 will open, allowing the shock piston 11 and piston rod 14 to extend. When the shock load has passed, a return valve 24 will open allowing the shock piston 11 and piston rod 14 to return.

The metal parts of the trim cylinder 10, as well as the rest of the outboard drive unit are protected from galvanic corrosion by a cathodic protection system 25 such as an impressed current cathodic protection circuit or a sacrificial anode made from a metal less noble than the protected metals. To be protected by such a system, a metal part must be reliably electrically connected to the cathodic protection system.

In the present system the aluminum cylinder 13 is connected to the cathodic protection system 25 by metal wrapped hydraulic hoses 26. The stainless steel piston rod 14 is electrically insulated from the cylinder 13 by the O-rings 19 and 20 and from the outboard propulsion unit by rubber bushing 17. Thus a continuity spring 27 is provided to make a reliable electrical connection between the piston rod 14 and the cylinder end cap 15 and thus to the cathodic protection system 25.

The continuity spring 27 is mounted in an annular groove 28 in the cylinder end cap 15. Preferably the spring 27 is made from a round spring wire such as spring temper brass, phosphor bronze, or 18% nickle silver, all of which are softer than the stainless steel piston rod 14, to avoid wear on the rod 14. The continuity spring 27 is formed as a partial circle with a diameter approximately matching the bottom diameter of the annular groove 28. Midway between the ends of the spring 27 is a straight section 29, long enough to form a chord intersecting the piston rod 14. With the piston rod 14 in place the straight section 29 will be deformed to produce forced contact with the rod 14. The primary electrical contact with the cylinder 13 will be made by the ends of the straight section 29, while the contact with the piston rod 14 will be made by the middle of the straight section 29.

The annular groove 28 is substantially wider (two to three times) than the diameter of the continuity spring 27 to assure movement of the spring 27 in the groove 28 as the piston rod 14 reciprocates. This movement creates a rubbing action which assures electrical contact between the continuity spring 27 and the annular groove 28. The annual groove 28 is placed between O-rings 20 to trap any wear particles from the continuity spring 27.

We claim:

1. In a hydraulic piston-cylinder for marine applications, of the type having a metal cylinder with closed ends, a piston slidably mounted in said cylinder, and a metal piston rod attached to one end of said piston and extending out one end of said cylinder, and wherein said piston rod is electrically insulated from said cylinder, the improvement comprising:

a sliding metal contact mounted between said piston rod and said cylinder to assure electrical contact therebetween as said piston rod reciprocates.

2. The device defined in claim 1 wherein said sliding metal contact comprises a spring to assure contact between said piston rod and said cylinder.

3. The device defined in claim 2 further comprising a slot in said cylinder and said spring is mounted in said slot.

4. The device defined in claim 3 wherein said slot is larger than said spring, whereby said spring moves in said slot as said piston rod reciprocates.

5. The device defined in claim 4 wherein said spring is formed of a wire section.

6. The device defined in claim 5 wherein said slot is annular and surrounds said piston rod.

7. The device defined in claim 6 wherein said spring comprises a portion having its ends in contact with said cylinder and its middle in contact with said rod.

8. The device defined in claim 7 wherein said spring partially encircles said piston rod.

9. The device defined in claim 8 wherein said spring has two arc portions on each side of said straight portion.

10. The device defined in claim 9 wherein said arc portions are of approximately the same diameter as said annular slot.

11. The device defined in claim 10 wherein said piston rod is formed of stainless steel, said cylinder is formed of aluminum, and said spring is formed of brass or bronze.

* * * * *